US009592943B2

(12) United States Patent
Talerico

(10) Patent No.: US 9,592,943 B2
(45) Date of Patent: Mar. 14, 2017

(54) ADVERTISING PACKAGE

(71) Applicant: American Sales Industries, LLC, Riviera Beach, FL (US)

(72) Inventor: Pasquale J. Talerico, Riviera Beach, FL (US)

(73) Assignee: American Sales Industries, LLC, Riviera Beach, FL (US)

( * ) Notice: Subject to any disclaimer, the term of this patent is extended or adjusted under 35 U.S.C. 154(b) by 0 days.

(21) Appl. No.: 14/680,408

(22) Filed: Apr. 7, 2015

(65) Prior Publication Data

US 2015/0284130 A1 Oct. 8, 2015

Related U.S. Application Data

(60) Provisional application No. 61/976,218, filed on Apr. 7, 2014.

(51) Int. Cl.
*B65D 69/00* (2006.01)
*B65D 71/00* (2006.01)
*B65D 75/24* (2006.01)

(52) U.S. Cl.
CPC ..... *B65D 75/245* (2013.01)

(58) Field of Classification Search
CPC .... B65D 77/24; B65D 75/367; B65D 75/368; B65D 5/0085; B65D 69/00; B65D 75/245; B65D 71/00
USPC ..... 206/232, 564, 470, 0.8, 734, 449, 38.1, 206/37.4, 557, 524.8, 829, 472, 473; 229/92.8
See application file for complete search history.

(56) References Cited

U.S. PATENT DOCUMENTS

| | | | | |
|---|---|---|---|---|
| 4,892,195 | A * | 1/1990 | Slavin | B65D 75/566 206/459.5 |
| 5,887,749 | A * | 3/1999 | Schommer | A01K 5/0114 206/564 |
| 6,357,592 | B1 * | 3/2002 | Coia | B42F 7/06 206/232 |
| 7,556,152 | B2 * | 7/2009 | Lechelle | B65D 75/24 206/470 |
| 8,584,841 | B1 * | 11/2013 | Tiegs | B65D 69/00 206/232 |
| 2001/0000732 | A1 * | 5/2001 | Hopkins, Sr. | A23L 1/0128 426/106 |
| 2005/0173286 | A1 * | 8/2005 | Hansen | B65D 77/006 206/472 |

* cited by examiner

*Primary Examiner* — J. Gregory Pickett
*Assistant Examiner* — Rafael Ortiz
(74) *Attorney, Agent, or Firm* — McHale & Slavin, P.A.

(57) ABSTRACT

Disclosed is an advertising package that consists of two trays that are hingedly attached along a longitudinal and transverse axis. One tray includes two compartments formed from substantially rectangular shapes to allow inclusion of items that are not distinctive in shape such as a coin, key or the like. The compartments are depressions which eliminates the need for upstanding side walls and the need for a circumscribing channel or coupling passageways. Printed material can be placed on the entirety of the first tray which provides a background to the compartments and allows viewing through the package sidewalls. The package is constructed and arranged to be sent as non-machinable flat through the United States Postal Service (USPS).

14 Claims, 5 Drawing Sheets

ADVERTISING PACKAGE

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/976,218, entitled "ADVERTISING PACKAGE", filed Apr. 7, 2014. The contents of which the above referenced application is incorporated herein by reference.

FIELD OF THE INVENTION

The present invention relates to the field of advertising and, in particular, to an advertising package employing interlocking trays constructed and arranged to be shipped as a non-machinable flat package through the United States Postal Service (USPS).

BACKGROUND OF THE INVENTION

Advertising packages are known in the art. Such packages can be of a size and shape that can be sent through the U.S. mail or through couriers having certain size requirements for cost effective shipping. Further, such packages may be transparent making the packaging adaptable to various types of advertising without opening. Such packages may house materials that can be sent through the mail allowing an advertiser to display a commercial message in a structure that will draw attention to the advertiser. Such packages may include gift cards, vehicle keys and the like articles used for advertisement and promotional purposes.

For instance U.S. Pat. No. 7,556,152 discloses a tray intended for the packaging of at least one article. The tray includes two parts connected together by an articulation zone enabling the tray parts to pivot relative to each other about an axis. A first tray part forms at least one open compartment. One of the two parts includes at least two fastening means capable of engaging with two counterpart fastening means formed on the other of the two parts so as to hold both parts in a first position in which the compartment formed by the first part delimits together with the second part a closed recess capable of receiving an article. One of the two parts is also provided with at least two indentations configured to receive, in a second position of the two parts, the fastening means of a second identical tray positioned against the first.

U.S. Pat. No. 8,584,841 discloses a container having a first and second portion hingedly mounted together. The first portion defines an internal cavity for enclosing individual objects of interest. The container is defined by three individual compartments. The first compartment is rectangular shaped and has a longitudinal axis which is substantially coaxially oriented relative to the longitudinal axis of the first portion, the second compartment is shaped like a mechanical key for operating an automobile and which further has a longitudinal axis which is substantially parallel to the transverse axis of the first portion, and the third compartment is rectangular shaped and further has a longitudinal axis which is substantially parallel to the transverse axis of the first portion. Each of the compartments are defined by a separate, substantially continuous, and uninterrupted sidewall. While the second compartment is shaped like a mechanical key for operating an automobile; a piece of printed advertising having opposite printed sides is positioned entirely within the first compartment and a facsimile of a credit, debit or gift card is solely positioned within the third compartment. The piece of printed advertising, mechanical key and the facsimile of a credit, debit or gift card do not come into contact with each other when received within the respective first, second and third compartments. The first and second portions when releasably coupled together have a resulting thickness dimension of less than 0.25 inches, a length dimension of less than 8.65 inches, and a width dimension of less than 4.5 inches, and wherein the resulting container formed from the first and second portions can be accepted and processed by automated letter-sized mail handling equipment, and delivered to a consumer by the United States Postal Service (USPS).

An objective of the invention is proposed packaging which does not present the drawbacks of the prior art.

SUMMARY OF THE INVENTION

Disclosed is an advertising package that consists of two trays that are hingedly attached along a longitudinal and transverse axis for ease of access opening and closing. One tray includes two compartments formed from substantially rectangular shapes to allow inclusion of items that are not distinctive in shape such as a coin, key or the like. The compartments do not interlock but rather employ an advertising material to help maintain items placed into the compartment in position. The compartments are depressions which eliminate the need for upstanding side walls and the need for a circumscribing channel or coupling passageways. The instant invention allows printed material to be placed on the entirety of the first tray which provides a background to the compartments and allows viewing through the package sidewalls. The invention does not require posts and has a thickness of about 0.30 inches which is constructed and arranged to be sent as non-machinable flat through the United States Postal Service (USPS).

An objective of the invention is to provide a more open and simple design than what is known in the industry.

Still another objective of the invention is to provide an open design that has consolidated the look by removing existing superfluous compartments making the advertising easier to read.

Another objective of the invention is to provide an advertising piece that can be placed along the entire length of the design allowing for greater exposure.

Still another objective of the invention is to provide an advertising piece that eliminates the use of shaped compartments that limit the use of the advertisement.

Still another objective of the invention is to provide an advertising piece that places the card compartment in the horizontal position, allowing easier more natural viewing for the end client.

Yet still another objective of the invention is to provide an advertising piece that opens in a typical book fashion allowing for an easier opening experience.

Other objectives and further advantages and benefits associated with this invention will be apparent to those skilled in the art from the description, examples and claims which follow.

DETAILED DESCRIPTION OF THE INVENTION

Figure 1:
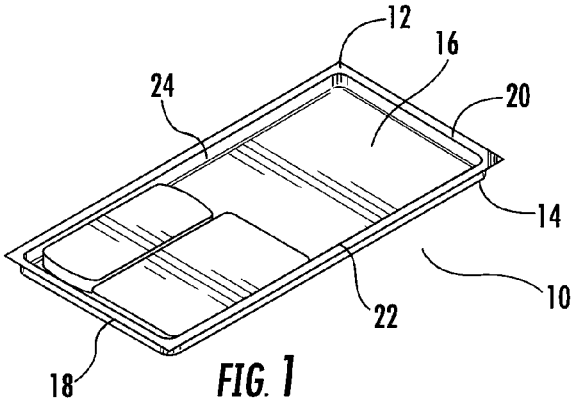
FIG. 1 is a perspective view of the package in a closed position.

Referring now to FIGS. 1-6 in general, set forth is a first embodiment of an advertising package or tray 10 formed from a first part 12 and a second part 14. The first part 12 has an outer surface 16 bounded by a first end wall 18, a second end wall 20, a first side wall 22 and an opposing side wall 24. The first part 12 is secured to the second part 14 wherein side walls 16, 18, 22 and 24 intermesh with the second part 14; having corresponding end walls 26 and 28, and corresponding side walls 30 and 32. In a first embodiment, end walls 18, 26 form a transverse living hinge. As further shown in FIGS. 3 and 5, the second part 14 has an inner surface 34 which forms a substantially rectangular shape with a longitudinal length formed by side walls 30 and 32 and a width formed by end walls 26 and 28.

Figure 2:
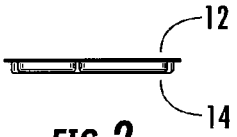
FIG. 2 is an end view of FIG. 1.
Figure 3:
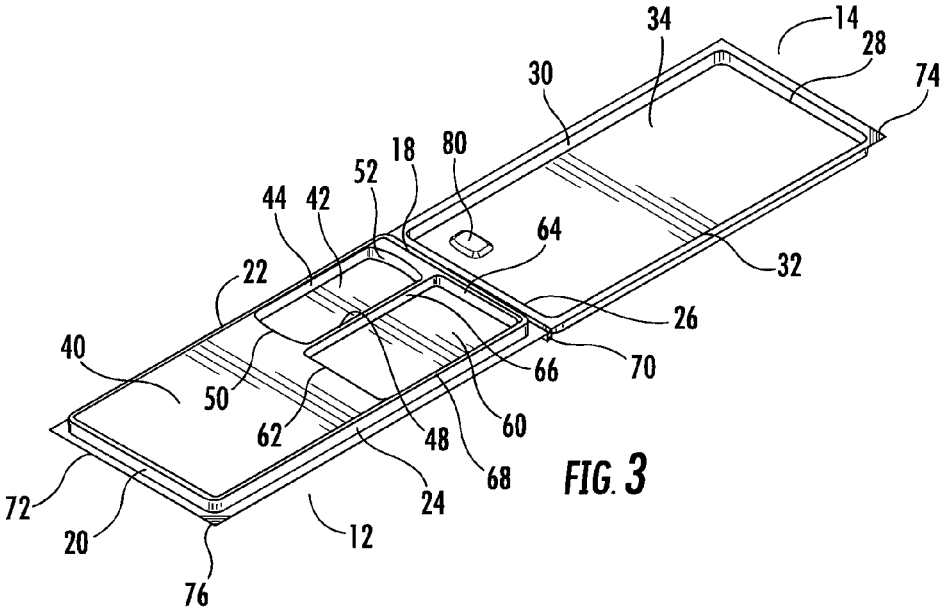
FIG. 3 is a perspective view of the package in an open position.
Figure 4:
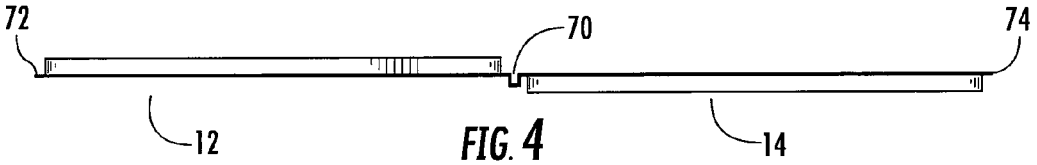
FIG. 4 is a side view thereof.
Figure 5:
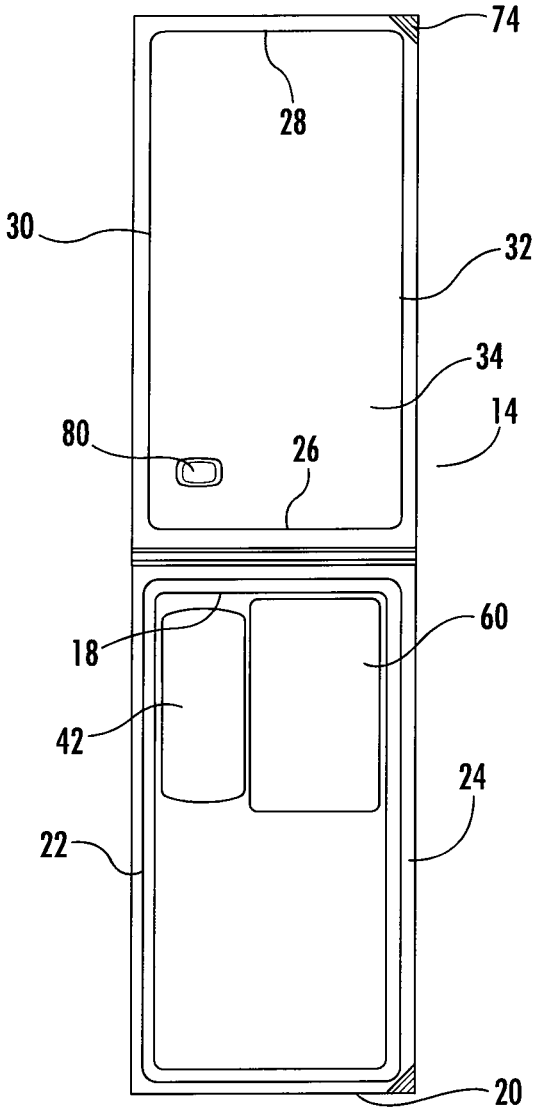
FIG. 5 is a top view thereof.
Figure 6:
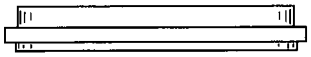
FIG. 6 is an end view thereof.

The overall length along the side walls of the first part and the second part, equal 17.14 inches combined, wherein each end width of the first part equaling the second part, of about 4.25 inches. The thickness of the first and second part 12 and 14, illustrated in FIG. 2, is approximately 0.30 inches. It should be noted that a thickness greater than 0.25 inches will ensure the package will be accepted by the United States Postal Service (USPS) as a non-machinable flat item qualifying for Every Door Direct Mail (EDDM), which is the least expensive way to ship such products.

The tray can be formed by molding a thermoplastic material from a single piece, for example, by thermoforming or thin-wall injection molding. The tray is, for example, made of a thermoplastic material chosen among the polyvinyl chlorides. Thermoforming includes polyvinyl chlorides, polypropylenes, polyethylenes, polystyrenes, or a combination thereof.

The first part 12 has an inner surface 40, which is raised from side walls 22 and 24 and end walls 20 and 18, forming a substantially flat inner surface 40, with a first compartment 42 formed as a depression from the inner surface 40, defining a length by side wall 44 and 48 and end walls 50 and 52. It is noted that end walls 50 and 52 may be slightly curved, but overall, the size of the first compartment is substantially rectangular. The second compartment 60 includes a first end wall 62 and second end wall 64 with opposing side walls 66 and 68, forming a substantially rectangular depression. The first and second compartments 42 and 60 are available for insertion of articles of display for use in advertising. Unique to this invention is the ability to place a thin form of advertisement, such as a paper sheet, placed on the inner surface 40, overlying the first compartment 42 and second compartment 60. The second tray 14 can be folded over the first tray 12 when the inner surface 34 entraps the paper advertisement placed along inner surface 40 and overlying items of display placed in the first compartment 42 and the second compartment 60. The side walls 30 and 32 of the second tray 14 frictionally engage the side walls 22 and 24 of the first tray 12, to secure the items of display placed on surface 40, within first compartment 42 and second compartment 60, in a secured position. Similarly, end walls 26 and 28 engage side walls 18 and 20 of the first part so as to further capture the materials in between. This frictional engagement between the first tray sidewalls 18, 20, 22, 24 and the second tray sidewalls 26, 28, 30, 32 provides a two-part means for securing the first tray to the second tray where the first part is the first tray sidewalls and the second part is the second tray sidewalls. A living hinge 70 is formed between the first tray 12 and the second tray 14, which allows the trays to be opened along the width portion of the trays for ease of accessing the advertisement and items placed within the first compartment 42 and second compartment 60. A flange 72 is formed around the first part 12. Similarly, a flange 74 is formed around the second part 14. The flange 72 allows ease of access of separating the first tray from the second tray, typically by pulling along an edge tab 76. The flange further eliminates a sharp edge along the side wall and creates a positive seal.

When an advertisement and articles of advertisement are placed within the trays, the materials may be opened in a typical book-like fashion, allowing more intuitive opening of the package, versus known packaging. In addition, this presents the advertising material in a horizontal position, again in the shape of a booklet format for making the advertising easier to read. The shapes of the compartments have a rectangular form which is similar to the overall shape of the trays, but are reduced in size so as to provide two distinct compartments. While the exact same compartment size could be made, it is determined that the second compartment 60 is best sized for gift cards, credit cards, and the like, whereas the first compartment 42 is sized for other materials allowing ease of separation during assembly, as well as shipping. The compartments do not interlock, and materials placed within the compartments are secured by the use of the advertisement which encompasses the inner surface 40 and the first and second compartments 42 and 60. In addition, a protruding lug or tab 80 is formed in the second tray 14 that can be used to help stabilize items that are placed within the first compartment 42. The protruding lug or tab 80 causes a slight indentation of the advertisement, which allows smaller items to be placed within the first compartment.

A preferred embodiment of the present invention is set out in FIGS. 7-10. The preferred embodiment of the advertising package or tray 110 is formed from a first part 112 and a second part 114. The first part 112 has an inner surface 140 bounded by a first end wall depression 118, a second end wall depression 120, a first side wall depression 122 and a second side wall depression 124. The first part 112 is secured to the second part 114 wherein the perimeter wall depressions 116, 118, 122 and 124 intermesh with the second part 114; having corresponding end walls 126 and 28, and corresponding side walls 130 and 132, each which has a thickness corresponding to the perimeter depressions of the first part 112. In the preferred embodiment, the flange at end walls 122, 130 forms a longitudinal living hinge 170.

Figure 7:
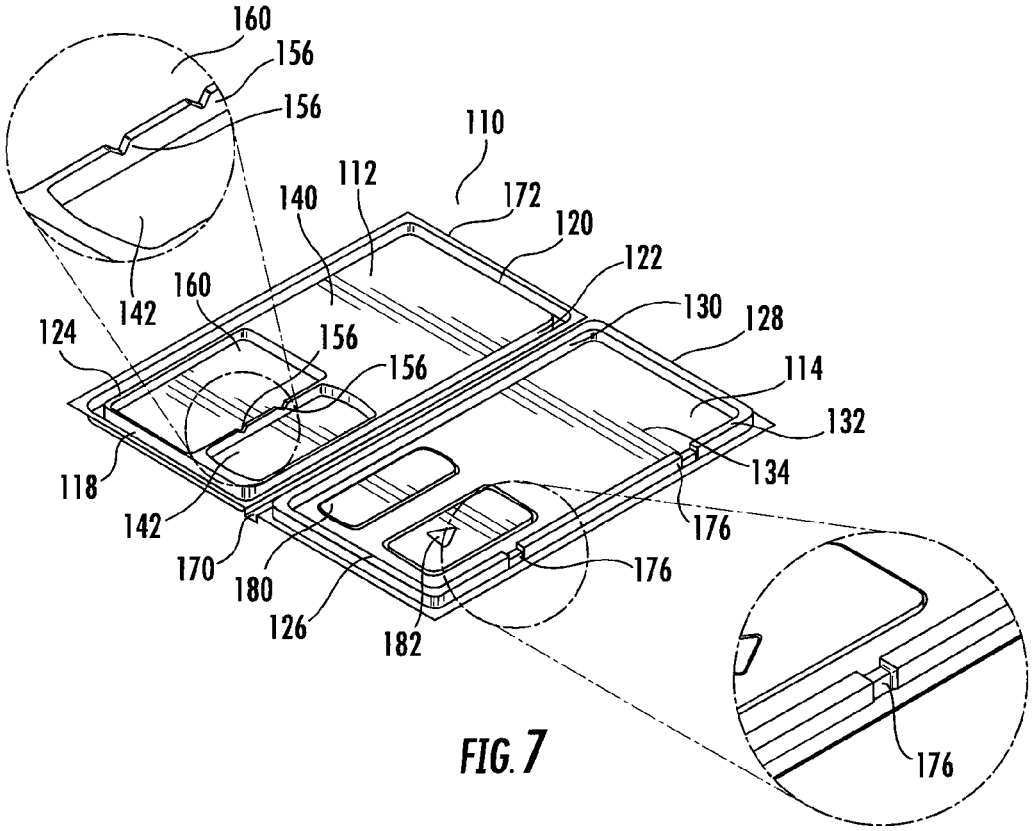
FIG. 7 is a perspective view of an alternate embodiment of the package in an open position.
Figure 8:
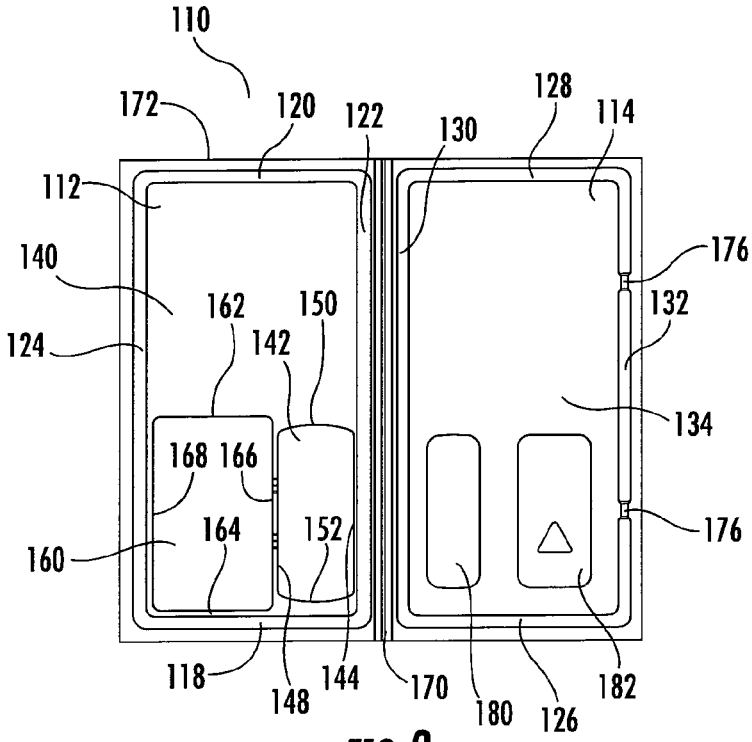
FIG. 8 is a top view of FIG. 7.
Figure 9:
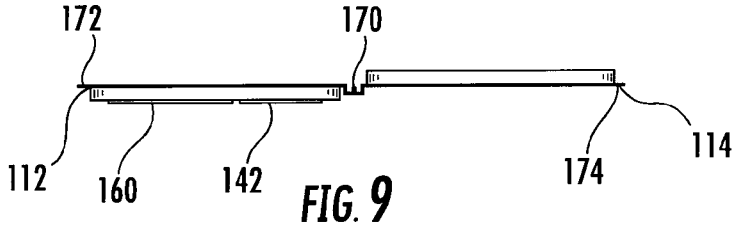
FIG. 9 is an end view of FIG. 7.

As further shown in FIGS. 7 and 8, the second part 114 has an inner surface 134 which forms a substantially rectangular shape with a longitudinal length formed by side walls 130 and 132 and a width formed by end walls 126 and 128.

The overall length along the side walls of each of the first part and the second part, equal 8.75 inches, and the combined width of the first part and second part equal 9.5 inches.

Figure 10:
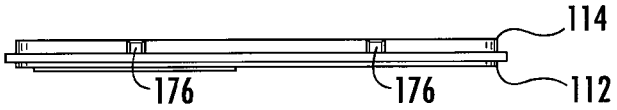
FIG. 10 is a side view of the alternate embodiment in a closed position.

The thickness of the first and second part 112 and 114, illustrated in FIG. 10, is approximately 0.30 inches. It should be noted that a thickness greater than 0.25 inches is necessary to ensure the package will be accepted by the United States Postal Service (USPS) as a non-machinable flat item qualifying for Every Door Direct Mail (EDDM), which is the least expensive way to ship such products.

The tray 110 can be formed by molding a thermoplastic material from a single piece, for example, by thermoforming or thin-wall injection molding. The tray 110 is, for example, made of a thermoplastic material chosen among the polyvinyl chlorides. Thermoforming includes polyvinyl chlorides, polypropylenes, polyethylenes, polystyrenes, or a combination thereof.

The first part 112 has an inner surface 140, which is raised from side walls 122 and 124 and end walls 120 and 118, forming a substantially flat inner surface 140, with a first compartment 142 formed as a depression from the inner surface 140, defining a length by side wall 144 and 148 and end walls 150 and 152. It is noted that end walls 150 and 152 may be slightly curved, but overall, the size of the first compartment is substantially rectangular. The second compartment 160 includes a first end wall 162 and second end wall 164 with opposing side walls 166 and 168, forming a substantially rectangular depression. The first and second compartments 142 and 160 are available for insertion of articles of display for use in advertising. Unique to this invention is the ability to place a thin form of advertisement, such as a paper sheet, placed on the inner surface 140, overlying the first compartment 142 and second compartment 160. The second tray 114 can be folded over the first tray 112 when the inner surface 134 entraps the paper advertisement placed along inner surface 140 and overlying items of display placed in the first compartment 142 and the second compartment 160. The side walls 130 and 132 of the second tray 114 frictionally engage the side walls depressions 122 and 124 of the first tray 112, to secure the items of display placed on surface 140, within first compartment 142 and second compartment 160, in a secured position. Similarly, end walls 126 and 128 engage side walls depressions 118 and 120 of the first part 112 so as to further capture the materials in between. This frictional engagement between the first tray sidewall depressions 118, 120, 122, 124 and the second tray sidewalls 126, 128, 130, 132 provides a two-part means for securing the first tray to the second tray where the first part is the first tray sidewall depressions and the second part is the second tray sidewalls. A living hinge 170 is formed between the first part 112 and the second part 114, which allows the tray 110 to be opened along the length portion of the tray 110 for ease of accessing the advertisement and items placed within the first compartment 142 and second compartment 160. A flange 172 is formed around the first part 112. Similarly, a flange 174 is formed around the second part 114. The flange 172 allows ease of access of separating the first part from the second part. The flange further eliminates a sharp edge along the side wall and creates a positive seal.

When an advertisement and articles of advertisement are placed within the trays, the materials may be opened in a typical book-like fashion, allowing more intuitive opening of the package, versus known packaging. In addition, this presents the advertising material in a horizontal position, again in the shape of a booklet format for making the advertising easier to read. The shapes of the compartments have a rectangular form which is similar to the overall shape of the trays, but are reduced in size so as to provide two distinct compartments. While the exact same compartment size could be made, it is determined that the second compartment 160 is best sized for gift cards, credit cards, and the like, whereas the first compartment 142 is sized for other materials allowing ease of separation during assembly, as well as shipping. The compartments do not interlock, and materials placed within the compartments are secured by the use of the advertisement which encompasses the inner surface 140 and the first and second compartments 142 and 160. In addition, protruding lugs or tabs 180, 182 are formed in the second tray 114 that can be used to help stabilize items that are placed within the first and second compartments 142, 160. The protruding lugs or tabs 180, 182 cause a slight indentation of the advertisement, which allows smaller items to be placed within the first compartment.

Highlighted in the detailed views of FIG. 7, the preferred embodiment of the advertising tray 110 contains air channels 156 between the first compartment 142 and the second compartment 160. Additionally, on side wall 132 on the second part 114 there are air channels 176 on the three inner faces of side wall 132. When closing the tray 110 by intermeshing the first part perimeter depression with the second part sidewalls, these air channels 156, 176 allow air to move from the first compartment 142 to the second compartment 160 and exit from the inside of the closed tray 110 to create a tighter seal without excess air trapped within tray 110. This allows the tray to tightly intermesh throughout the entire area of the first and second parts 112, 114 without a bubbling, or bowing, effect caused by trapped air in the middle.

Figure 11:
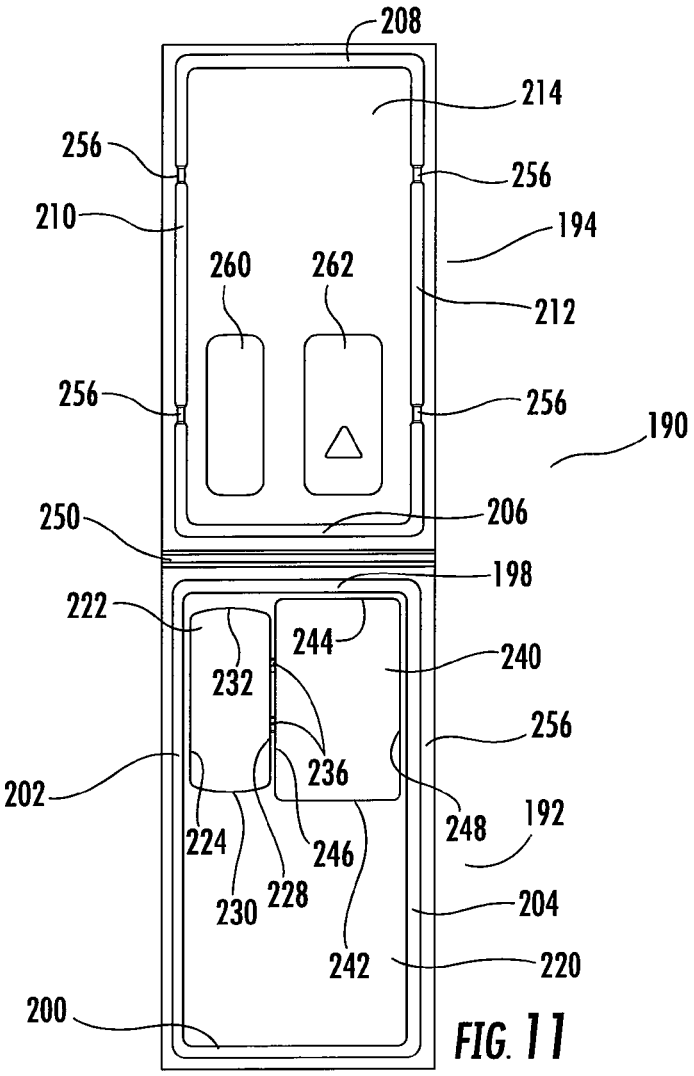
FIG. 11 is a top view of a third embodiment of the package in an open position.
Figure 12:
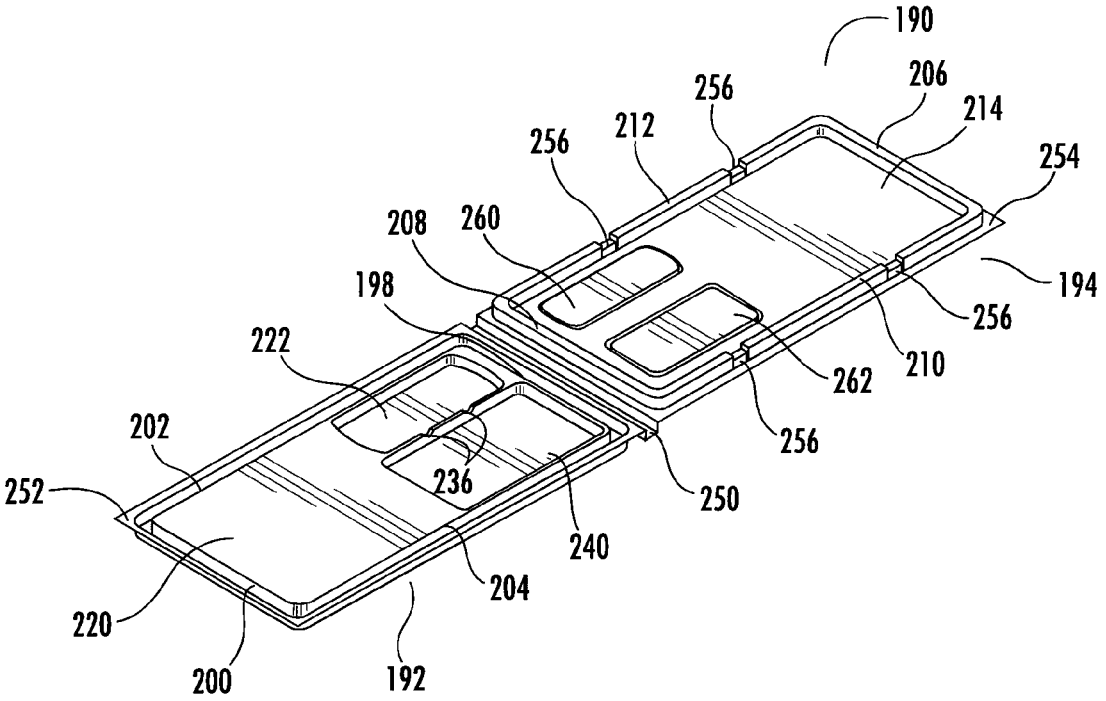
FIG. 12 is a perspective view of FIG. 11.

A final embodiment is disclosed in FIGS. 11-12. This embodiment incorporates the structure of the preferred embodiment, but with the living hinge 250 on transverse edge of the tray 190 as opposed to the longitudinal edge of the preferred embodiment of FIGS. 7-10.

Looking to FIGS. 11-12, disclosed is an advertising package or tray 190, formed from a first part 192 and a second part 194. The first part 192 has an inner surface 220 bounded by a first end wall depression 198, a second end wall depression 200, a first side wall depression 202 and a second side wall depression 204. The first part 192 is secured to the second part 194 by a living hinge 250, wherein the perimeter wall depressions 198, 200, 202 and 204 intermesh with the second part 114; having respectively corresponding end walls 208 and 206, and respectively corresponding side walls 212 and 210, each of which has a thickness corresponding to the perimeter depressions of the first part 112. In this embodiment, the flange 252, 254 at end walls 198, 208 forms the transverse living hinge 250.

As further shown in FIGS. 11-12, the second part 194 has an inner surface 214 which forms a substantially rectangular shape with a longitudinal length formed by side walls 210 and 212 and a width formed by end walls 206 and 208.

The overall length along the side walls of each of the first part and the second part, equal 8.75 inches, and the combined width of the first part and second part equal 9.5 inches. The thickness of the first and second part 192 and 194, is approximately 0.30 inches. It should be noted that a thickness greater than 0.25 inches is necessary to ensure the package will be accepted by the United States Postal Service (USPS) as a non-machinable flat item qualifying for Every Door Direct Mail (EDDM), which is the least expensive way to ship such products.

The tray 190 can be formed by molding a thermoplastic material from a single piece, for example, by thermoforming or thin-wall injection molding. The tray 190 is, for example, made of a thermoplastic material chosen among the polyvinyl chlorides. Thermoforming includes polyvinyl chlorides, polypropylenes, polyethylenes, polystyrenes, or a combination thereof.

The first part 192 has an inner surface 220, which is raised from side walls 202 and 204 and end walls 198 and 200, forming a substantially flat inner surface 220, with a first compartment 222 formed as a depression from the inner surface 220, defining a length by side wall 224 and 228 and end walls 230 and 232. It is noted that end walls 230 and 232 may be slightly curved, but overall, the size of the first compartment is substantially rectangular. The second compartment 240 includes a first end wall 242 and second end wall 244 with opposing side walls 246 and 248, forming a substantially rectangular depression. The first and second compartments 222 and 240 are available for insertion of articles of display for use in advertising. This embodiment also allows for the ability to place a thin form of advertisement, such as a paper sheet, placed on the inner surface 220, overlying the first compartment 222 and second compartment 240. The second tray 194 can be folded over the first tray 192 when the inner surface 214 entraps the paper advertisement placed along inner surface 220 and overlying items of display placed in the first compartment 222 and the second compartment 240. The side walls 210 and 212 of the second tray 194 frictionally engage the side walls depressions 202 and 204 of the first tray 192, to secure the items of display placed on surface 220, within first compartment 222 and second compartment 240, in a secured position. Similarly, end walls 206 and 208 engage side walls depressions 198 and 200 of the first part 192 so as to further capture the materials in between. This frictional engagement between the first tray sidewall depressions 198, 200, 202, 204 and the second tray sidewalls 206, 208, 210, 212 provides a two-part means for securing the first tray to the second tray where the first part is the first tray sidewall and the second part is the second tray sidewalls. A living hinge 250 is formed between the first part 192 and the second part 194, which allows the tray 190 to be opened along the transverse portion, or width, of the tray 190 for ease of accessing the advertisement and items placed within the compartments. A flange 252 is formed around the first part 192. Similarly, a flange 254 is formed around the second part 194. The flanges 252, 254 allow ease of access of separating the first part 192 from the second part 194. The flanges further eliminate a sharp edge along the side wall and creates a positive seal.

When an advertisement and articles of advertisement are placed within the tray, the materials may be opened in a typical book-like fashion, allowing more intuitive opening of the package, versus known packaging. In addition, this presents the advertising material in a horizontal position, again in the shape of a booklet format for making the advertising easier to read. The shapes of the compartments have a rectangular form which is similar to the overall shape of the trays, but are reduced in size so as to provide two distinct compartments. While the exact same compartment size could be made, it is determined that the second compartment 240 is best sized for gift cards, credit cards, and the like, whereas the first compartment 222 is sized for other materials allowing ease of separation during assembly, as well as shipping. The compartments do not interlock, and materials placed within the compartments are secured by the use of the advertisement which encompasses the inner surface 220, 214 and the first and second compartments 142 and 160. In addition, protruding lugs or tabs 260, 262 are formed in the second tray 194 that can be used to help stabilize items that are placed within the first and second compartments 222, 240. The protruding lugs or tabs 260, 262 cause a slight indentation of the advertisement, which allows smaller items to be placed within the first compartment.

Advertising tray 190 also contains air channels 236 between the first compartment 222 and the second compartment 240. Additionally, on the side walls 210, 212 of the second part 194 there are air channels 256 on the three inner faces of the side walls 210, 212. When closing the tray 190 by intermeshing the first part perimeter depression with the second part sidewalls, these air channels 236, 256 allow air to move from the first compartment 222 to the second compartment 240 and exit from the inside of the closed tray 190 to create a tighter seal between the first and second parts without excess air trapped within the tray 190. This allows the tray to tightly intermesh throughout the entire area of the first and second parts without a bubbling, or bowing, effect caused by trapped air in the middle.

Detailed embodiments of the instant invention are disclosed herein, however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

All patents and publications mentioned in this specification are indicative of the levels of those skilled in the art to which the invention pertains. All patents and publications are herein incorporated by reference to the same extent as if each individual publication was specifically and individually indicated to be incorporated by reference. It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A tray for packaging at least one article comprising:

a first part and a second part connected together by a living hinge enabling the first and second parts to pivot relative to each other about an axis, such that the tray is movable between a first position in which the tray is open and a second position in which the tray is closed, said tray in said second position having a thickness greater than 0.25 inches thereby meeting the size requirements of the USPS for Every Door Direct Mail (EDDM);

the first part includes a first panel having a first and a second substantially rectangular shaped compartment, each said compartment formed from a depression in said first panel, each said compartment constructed and arranged for receipt of an article, said first compartment having two opposing side walls and two opposing end walls, said end walls having a curved shape, said first compartment side walls and end walls having thickness, said second compartment having two opposing side walls and two opposing end walls, said second compartment side walls and end walls having a thickness, at least one air channel providing fluid communication between a side wall of said first compartment and a side wall of said second compartment allowing passage of air between said first and second compartments when said tray is in said second position, said first part having an outer wall formed from a depression around the perimeter of said first panel, said outer wall having a thickness, said outer wall constructed and arranged for frictional engagement with the second part; and the second part includes a second panel having a perimeter, said second panel corresponding to said first panel when the tray is in said closed position, said second panel contains a first and second protruding lug corresponding to said first and second compartments on said first panel for placement over said first and second compartments sufficient to retain an article placed in said first and second compartments when said first part and said second part are in said closed second position, said second part having a securing wall around said perimeter of said second panel, said securing wall having a thickness corresponding to said first part outer wall thickness, said securing wall constructed and arranged for frictional engagement with said first part outer wall when the tray is in said second closed position, said securing wall having at least one channel providing fluid communication between said first and second compartments and an ambient environment.

2. A tray according to claim 1, wherein said first part has a thickness of about0.30 inches.

3. A tray according to claim 1, wherein said second part has a thickness of about 0.30 inches.

4. The tray according to claim 1, wherein said tray is formed by molding a thermoplastic material as a single piece.

5. The tray according to claim 4, wherein said tray is formed by one of thermoforming a thermoplastic material selected from the group consisting of: polyvinyl chlorides, polypropylenes, polyethylenes, polystyrenes, or a combination thereof.

6. The tray according to claim 1, wherein said first part includes an inner surface with a side wall depending therefrom forming a first element of a securing means.

7. The tray according to claim 6, wherein said first part side wall includes a flange surrounding said at least one compartment.

8. The tray according to claim 6, wherein said second part includes an inner surface with a side wall extending upwardly therefrom forming a second element of said securing means.

9. The tray according to claim 8, wherein said second part side wall includes a flange surrounding said at least one compartment.

10. The tray according to claim 1, wherein said trays have a longitudinal length formed by side walls and a width formed by end walls, said trays pivotable along one said end wall.

11. The tray according to claim 1, where said living hinge is on a longitudinal axis of said first and second parts.

12. The tray according to claim 1, where said living hinge is on a transverse axis of said first and second parts.

13. The tray according to claim 1, where said common wall is substantially parallel to a longitudinal axis of said tray.

14. A tray for packaging at least one article comprising:

a first part and a second part connected together by a living hinge enabling the first and second parts to pivot relative to each other about an axis, such that the tray is movable between a first position in which the tray is open and a second position in which the tray is closed, said first part and said second part each having a thickness of about 0.30 inches;

the first part includes a first panel having a first and a second substantially rectangular shaped compartment, each said compartment formed from a depression in said first panel, each said compartment constructed and arranged for receipt of an article, said first and second compartments having a common wall between them with at least one channel for air passage when said tray is in said second closed position, said first part having an outer wall formed from a depression around the perimeter of said first panel, said outer wall having a depth, said outer wall constructed and arranged for frictional engagement; and the second part including a second panel having a perimeter, said second panel corresponding to said first panel in said closed position, said second panel containing a first and second protruding lug corresponding to said first and second compartments on said first panel for placement over said first and second compartments sufficient to retain an article placed in said first and second compartments when said first part and said second part are in said closed second position, said second part having a securing wall around said perimeter of said second panel, said securing wall having a height corresponding to said first part outer wall depth, said securing wall constructed and arranged for frictional engagement with said outer wall of said first part in said second closed position, said securing wall having at least one air vent wherein air trapped within said tray when said tray is moved to said second closed position is expelled from said tray and said first part and second part are frictionally secured.

* * * * *